United States Patent [19]

Fukuda et al.

[11] Patent Number: 4,894,288

[45] Date of Patent: Jan. 16, 1990

[54] THERMAL TRANSFER MATERIAL

[75] Inventors: Tsuguhiro Fukuda; Hiroshi Sato, both of Yokohama, Japan

[73] Assignee: Canon Kabushiki Kaisha, Tokyo, Japan

[21] Appl. No.: 197,960

[22] Filed: May 24, 1988

[30] Foreign Application Priority Data

May 26, 1987 [JP] Japan ..... 62-130470

[51] Int. Cl.[4] ..... B41M 5/20

[52] U.S. Cl. ..... 428/422; 428/195; 428/212; 428/483; 428/484; 428/488.1; 428/488.4; 428/500; 428/913; 428/914

[58] Field of Search ..... 428/195, 484, 488.1, 428/488.4, 913, 914, 212, 483, 500, 422

[56] References Cited

U.S. PATENT DOCUMENTS 4,777,079 10/1988 Nagamoto et al. ..... 428/488.4

4,783,360 11/1988 Katayama et al. ..... 428/488.4

*Primary Examiner*—Pamela R. Schwartz

*Attorney, Agent, or Firm*—Fitzpatrick, Cella, Harper & Scinto

[57] ABSTRACT

A thermal transfer material, comprising: a support, an intermediate layer and a heat-transferable ink layer disposed in the order named on the support. The intermediate layer comprises oxidized polyethylene having a number-average molecular weight of 1300–2500, and at least one species selected from polyoxyethylene alkylaryl ether, fatty acid, resin acid, amine and sulfuric acid ester salt. The thermal transfer material provides a transfer image of high density and clear edges without lacking even on a recording medium having poor surface smoothness.

8 Claims, 2 Drawing Sheets

THERMAL TRANSFER MATERIAL

FIELD OF THE INVENTION AND RELATED ART

The present invention relates to a thermal transfer material for use in a thermal transfer recording method.

The thermal or heat-sensitive transfer recording method has recently been widely used because it has general advantages that the apparatus employed is light in weight, compact, free of noise, excellent in operability and adapted to easy maintenance, but and also has other advantages such that it does not require a color-formation type conversion paper yet provides recorded images with excellent durability.

The thermal transfer recording method generally employs a thermal transfer material comprising a heat-transferable ink layer containing a colorant dispersed in a heat-fusible material applied onto a support generally in the form of sheet. The recording is generally conducted by superposing the thermal transfer material on a recording medium such as paper so that the heat-transferable ink layer will contact the recording medium, supplying heat from the support side of the thermal transfer material by means of a thermal head, etc., to transfer the melted ink layer to the recording medium, thereby forming on the recording medium a transferred ink image corresponding to the heat supplying pattern.

When the adhesion between a heat-transferable ink layer and a recording medium at the time of peeling is $F_1$, the adhesion between the heat-transferable ink layer and a support in a heat-applied portion is $F_2$, the adhesion between the heat-transferable ink layer and the support in a non-heat-applied portion is $F_3$, and the cohesion in the heat-transferable ink layer is $F_4$, the condition for complete transfer of the heat-transferable ink layer to the recording medium may be considered to be $F_1$, $F_3 > F_4 > F_2$.

Incidentally, in the case of a wax-type heat-transferable ink layer using a wax-type heat-fusible material, the above cohesion $F_4$ is extremely small because such ink layer is completely melted by heat application. Therefore, while the above-mentioned condition is satisfied, image deformation is liable to occur. Alternatively, the printed letter has poor wear-resistance and, in the case of a recording medium with a low surface smoothness, the heat-transferable ink layer cannot contact concavities of the surface irregularities of the recording medium during transfer printing, but is transferred only to the convexities of the surface whereby a so-called transfer defect (or lacking of a transferred image) is caused. As a result, the printed letter quality is markedly lowered.

On the other hand, in the case of a resin-type heat-transferable ink layer using a resin-type heat-fusible material, no problem is posed in the above-mentioned image deformation and wear resistance of a printed letter. However, in the case of a recording medium with a low surface smoothness, it is required to effect printing so that the convexities of the recording medium surface may be bridged by the ink layer. Therefore, it is necessary to increase the cohesion ($F_4$) of the ink layer. As a result, the relationship between the cohesion $F_4$ and the above-mentioned adhesion $F_3$ becomes $F_4 > F_3$, whereby the sharpness of edge cutting of the heat-transferable ink layer is lowered at the boundary between the heated portion and the non-heated portion thereof, whereby so-called dull edge cutting occurs. Accordingly, there undesirably occur trailing of the printed letter and the transfer of the non-heated portion (i.e., non-selective transfer).

Further, when the ink layer is transferred to a recording medium so that the convexities of the recording medium surface may be bridged thereby, the ink layer does not contact the recording medium in the surface concavities thereof, whereby the ink layer is not transferred to the recording medium in these portions to sometimes cause a transfer defect.

In order to solve the above-mentioned problems, our research group has proposed thermal transfer materials as described in U.S. patent application Ser. Nos. 885,657 and 887,913. However, there has been desired a thermal transfer material which can provide a printed letter of better quality on a recording medium with a low surface smoothness.

SUMMARY OF THE INVENTION

A principal object of the present invention is to provide a thermal transfer material capable of giving printed letters or transferred images of high density and clear edges without transfer defects, not only on a recording medium having good surface smoothness but also on a recording medium having poor surface smoothness.

According to the present invention, there is provided a thermal transfer material comprising: a support, an intermediate layer, and a heat-transferable ink layer disposed in this order on the support; the intermediate layer comprising oxidized polyethylene having a number-average molecular weight of 1300–2500, and at least one species selected from the group consisting of polyoxyethylene alkylaryl ether, fatty acid, resin acid, amine and sulfuric acid ester salt.

In the thermal transfer material of the present invention, not only the above-mentioned condition of $F_3 > F_4$ is satisfied in a non-heated portion, but also a condition of $F_4 >> F_2$ is satisfied in a heated portion due to the complete melting of the intermediate layer, whereby a printed letter with clear edges is obtained.

These and other objects, features and advantages of the present invention will become more apparent upon a consideration of the following description of the preferred embodiments of the present invention taken in conjunction with the accompanying drawings. In the following description, "%" and "parts" representing quantity ratios are by weight unless otherwise noted specifically.

DETAILED DESCRIPTION OF THE INVENTION

Figure 1:
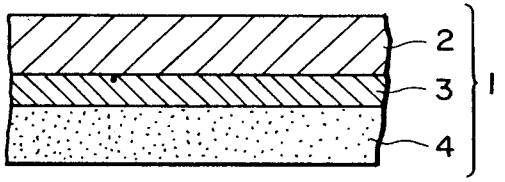
FIG. 1 is a schematic view showing a section across the thickness of an embodiment of the thermal transfer material according to the present invention.

Referring to FIG. 1, a thermal transfer material 1 according to the present invention comprises a support 2 generally in the form of a sheet, an intermediate layer 3, and a heat-transferable ink layer 4 comprising a heat-fusible material, disposed in this order on the support.

In the present invention, the intermediate layer refers to a layer closest to the support. The intermediate (or adhesive) layer 3 is so constituted that it has strong adhesions to the support 2 and to the heat-transferable ink layer 4 under no heat application, but is easily separated from the support 2 under heat application.

In the present invention, the intermediate layer 3 comprises oxidized polyethylene having a number-average molecular weight of 1300–2500, and at least one species selected from polyoxyethylene alkylaryl ether, fatty acid, resin acid, amine, and sulfuric acid ester salt.

When the intermediate layer 3 is formed on the support 2 by coating, it is preferred to use an emulsion containing a composition comprising these components in view of easy formation of a thin coating layer, and of easy handling of a coating liquid. However, the above-mentioned composition may be applied onto the support through hot-melt coating method or a method using a dispersion produced by dispersing the above components in a solvent under heating.

In the present invention, since the intermediate layer 3 comprises oxidized polyethylene having a number-average molecular weight of 1300–2500 (preferably 1400–2200), and at least one species selected from polyoxyethylene alkylaryl ether, fatty acid, resin acid, amine and sulfuric acid ester salt, in a non-heated portion of the thermal transfer material, the adhesion between the support 2 and the intermediate layer 3, and that between the intermediate layer 3 and the heat-transferable ink layer 4 are stable to drying temperature used in the formation thereof and to the elapse of time.

The reason for the above stability is not yet clear but may be considered as follows.

Since the oxidized polyethylene has good compatibility with a melt-viscosity modifier (component) selected from polyoxyethylene alkylaryl ether, fatty acid, resin acid, amine and sulfuric acid ester salt, the melt-viscosity modifier does not exude or ooze to the vicinity of the boundary between the intermediate layer 3 and the ink layer 4 or that between the intermediate layer 3 and the support 2, but may be present in the intermediate layer 3.

On the other hand, under heat application, the intermediate layer 3 according to the present invention is sharply melted and changed to a semiliquid state, and the melt viscosity thereof is low. As a result, the cohesion state in the intermediate layer 3 is easily broken and converted into a state suitable for the separation of the heat-transferable ink layer 4 from the support 2.

It may be proved by the following experiment whether such intermediate layer 3 has a desirable adhesion to the support 2 under a heat application.

The thermal transfer material of the present invention is superposed on a release paper of which surface has been treated with a silicone resin. Then, a pattern of heat corresponding to a solid image is supplied to the entire ink layer formed on the support by means of a heat-generating member so that the ink layer is not cut during the printing operation, e.g., by using an ink layer having a width smaller than that of the heat-generating member (i.e., total width of heating elements (dots). For example, the total width is about 5 mm when the heat-generating member comprises 48 dots arranged at a density of 240 dots/inch). At this time, it is observed whether the ink layer is transferred to the release paper.

Because the interfacial tension of a liquid disposed on a release paper which has been surface-treated with a silicone resin is extremely small, it is difficult for the heat-transferable ink layer to exert an adhesion on the release paper. Therefore, if a solid transferred image can be formed on the release paper in the above-mentioned experiment, it is clear that the adhesion ($F_2$) between the ink layer and the support is almost zero ($F_2 \approx 0$), in consideration of the above-mentioned condition for the transfer of the heat-transferable ink layer (i.e., $F_1 > F_2$).

In the above experiment wherein a solid image is transferred to a release paper by using the thermal transfer material of the present invention, the following printing conditions are preferred. Incidentally, the printing is conducted so that the release paper and the thermal transfer material have no relative velocity.

Printing Conditions

Length from the center of the heat-generating part to the end of the substrate of a thermal head: 150 μm
Thickness of the glaze of the thermal head: 45 μm
Preheating temperature of the thermal head: 45° C.
Printing speed: 40 cps (characters per second)
Printing power: 0.36 W/dot
Printing pulse width: 0.8 msec
Number of heating elements of the thermal head: 44 dots If the number-average molecular weight of the oxidized polyethylene used in the intermediate layer 3 is smaller than 1300, the softening point of the intermediate layer 3 is low and the thermal transfer material is undesirably liable to cause blocking, etc., in storage at a high temperature. If the number-average molecular weight is larger than 2500, the crystallinity thereof increases whereby a good adhesion to the support cannot be obtained or the softening point of the intermediate layer becomes too high. As a result, when an ordinary thermal head is used, heat applied to the thermal transfer material is liable to be insufficient, and the intermediate layer is not sufficiently melted whereby the transferability of the ink layer is lowered.

Incidentally, in the present invention, the number-average molecular weight of the oxidized polyethylene was measured according to the VPO method (Vapor Pressure Osmometry Method).

The intermediate layer 3 may preferably have a thickness of 0.01–5 μm, more preferably 0.1–2.5 μm. Further, in order to control the adhesion thereof to the support 2 and the heat-transferable ink layer 4, a third component may be contained in the intermediate layer 3 in an amount of preferably 50% or less, more preferably 30% or less based on the weight of the intermediate layer 3. Such third component may preferably include, e.g., a polar material such as an arcylic resin and a vinyl acetate resin; and a wax emulsion. In the case of the wax emulsion, the above-mentioned amount thereof is based on its solid content.

There is no particular limitation with respect to the method by which the oxidized polyethylene having a number-average molecular weight of 1300–2500, and at least one species selected from polyoxyethylene alkylaryl ether, fatty acid, resin acid, amine and sulfuric acid ester salt are incorporated into the intermediate layer 3. However, the following method is preferred.

For example, under heating and pressure, a neutralizing agent in an amount of not less than the equivalent required for neutralizing the acid value of oxidized polyethylene and at least one species of the above-mentioned melt-viscosity modifier preferably in an amount of 15–30%, more preferably 20–25% based on the weight of the oxidized polyethylene are added to the oxidized polyethylene, thereby to prepare an emulsion of the oxidized polyethylene. Then, the emulsion is applied onto a support and a dried to form the above-mentioned intermediate layer. Incidentally, the above neutralizing agent may preferably be used in order to neutralize the carboxyl group of the oxidized polyethylene and to improve the solubility thereof in water. Further, an amine as the melt-viscosity modifier also functions as the neutralizing agent.

The polyoxyethyl alkylaryl ether may include those having an alkyl group such as octyl, diisobutyl, lauryl, nonyl, dodecyl, diamyl and dinonyl. The molar ratio of the ethylene oxide contained in the polyoxyethylene alkylaryl ether varies depending on the molecular weight of the alkyl group, but the weight of the portion formed by the addition of ethylene oxide may preferably be 44–85% of the molecular weight.

The fatty acid may preferably be a saturated or unsaturated fatty acid having 12–18 carbon atoms. Examples thereof include: one having a straight chain structure such as palmitic acid, margaric acid and stearic acid; one having an alkyl group having a side chain, such as isostearic acid; and one having an unsaturated structure such as oleic acid and pulmitoleic acid.

The resin acid may include an alicyclic-type and an aromatic-type, but the former may mainly be used. Examples of the alicyclic resin mainly include diterpene acids contained in rosin or tall oil, such as abietic acid, neoabietic acid, d-pimaric acid, iso-d-pimaric acid, podocarpic acid, and agathendicarboxylic acid. The aromatic resin acid may include cinnamic acid, benzoic acid, and p-hydroxycinnamic acid.

The amine may include ammonia, alkanolamine, alkylamine, cyclic amine, etc.

The sulfuric acid ester salt may include: higher alcohol sulfuric acid ester salt (preferably having an alkyl group of $C_8$–$C_{18}$), secondary higher secondary alcohol sulfuric acid ester salt (preferably having an alkyl group of $C_8$–$C_{18}$), alkyl- and alkylaryl ether sulfuric acid ester salts, sulfuric acid ester salt of glycerin fatty acid ester, sulfuric acid ester of higher fatty acid alkylolamide, etc.

Further, the neutralizing agent may include: alkali metal hydroxide such as NaOH and KOH.

The intermediate layer 3 may preferably comprise a combination of oxidized polyethylene having number-average molecular weight of 1300–2500, a resin acid, and a neutralizing agent of an amine salt.

The heat-transferable ink layer 4 may comprise, in addition to a heat-fusible material, a colorant and other additive such as a dispersing agent, plasticizer, oil, and filler (including metal fine powder, inorganic fine powder, metal oxide fine powder, etc.), as desired.

The ink layer 4 may preferably comprise a resin-type heat-fusible material in an amount of 70% or more, based on the total weight of the heat-fusible material used in the ink layer. In this case, the transfer characteristics of the ink layer are remarkably improved and a transferred image without image deformation having good wear resistance may be obtained.

Further, the melting temperature of the heat-transferable ink layer 4 measured by a differential scanning calorimeter (DSC) is not particularly restricted, but the melting temperature may preferably be 50°–200° C., more preferably 70°–150° C. If the melting temperature exceeds 200° C, there may be posed problem of heat-resistance of the support whereby the kinds thereof may extremely be limited. Further, the durability of a thermal head may undesirably be lowered. If the melting temperature is lower than 50° C., non-selective transfer is undesirably liable to occur, even when a resin-type heat-fusible material is used.

The heat-fusible material constituting the heat-transferable ink layer 4 may preferably comprise a resin in an amount of 70% or more. Examples of such resin include: polyolefin resins, polyamide resins, polyester resins, epoxy resins, polyurethane resins, acrylic resins, polyvinyl chloride resins, vinyl acetate resins, cellulose resins, polyvinyl alcohol resins, petroleum resins, phenolic resins, styrene resins, vinyl acetate resins; elastomers such as natural rubber, styrene-butadiene rubber, isoprene rubber, chloroprene rubber and the like; polyisobutylene, polybutene. These components may be used singly or as a mixture.

These components may appropriately be mixed, as desired, with a material other than resin, including: natural waxes such as whale wax, beeswax, lanolin, carnauba wax, candelilla wax, montan wax, ceresin wax and the like; petroleum waxes such as paraffin wax and microcrystalline wax; synthetic waxes such as oxidized wax, ester wax, low-molecular weight polyethylene, Fischer-Tropsch wax and the like; higher fatty acids such as lauric acid, myristic acid, palmitic acid, stearic acid, behanic acid and the like; higher alcohols such as stearyl alcohol, behenyl alcohol and the like; esters such as fatty acid esters of sucrose, fatty acid esters of sorbitane and the like; amides such as oleic amide and the like; plasticizers, oils such as mineral oils or vegetable oils. The heat-fusible material may preferably be selected to provide a heat-transferabl ink layer having a melting point in the range of 50° to 200° C.

In the above-mentioned embodiment of the present invention, the heat-transferable ink layer 4 has a monolayer structure comprising one ink layer which comprises the above-mentioned heat-fusible material and an optional additive such as a colorant, dispersing agent, plasticizer and filler. However, the structure of the heat-transferable ink layer is not particularly restricted to such monolayer structure. More specifically, the heat-transferable ink layer may be function-separated into two layers including a layer having a function of exerting an adhesion on a recording medium when heated by means of a thermal head, and a layer having a function of coloring. Further, the heat-transferable ink layer may comprise three or more layers when another function is added thereto.

Hereinbelow, there is described an embodiment wherein the heat-transferable ink layer 4 comprises two layers. In this embodiment, the thermal transfer material comprises a support, an intermediate layer, a first ink layer, and a second ink layer, disposed in this order on the support.

The first ink layer fulfills a coloring function and also functions of controlling the film strength immediately after the heat application and the change with time thereafter of the film strength. The second ink layer fulfills a function of controlling the adhesiveness of the heated portion to the paper and also functions of controlling the strength immediately after the heat application and the change with time thereafter of the film strength similarly as the first ink layer.

The control of the film strength immediately after the heat application may be accomplished by appropriately selecting the materials for the respective ink layers from the group of materials mentioned above and adjusting the molecular weight and cohesion forces of such materials.

In order to obtain good transferability to a recording medium having a low surface smoothness, it is preferred that the cohesion and the molecular weight are as high as possible. Further, the change in film strength with elapse of time after the heat application may be controlled by appropriately changing proportion, crystallinity, cohesion force and molecular weight of materials selected for the respective layers from the above group of materials. It is particularly preferred to use a material having a high crystallinity and utilize a time delay until recrystallization. It is particularly preferred to use as a predominant component, i.e., 50% or more, in the first and second ink layers a resin or polymer component, preferably consisting predominantly of olefin, such as low-molecular weight oxidized polyethylene (preferably having a number-average molecular weight of 1300–2500), ethylene-vinyl acetate copolymer, vinyl acetate-ethylene copolymer, ethylene-acrylic acid copolymer, ethylenemethacrylic acid copolymer, ethylene-acrylic acid ester copolymer, or polyamide, polyester, etc.

Next, materials constituting the first and second ink layers are explained with respect to respective layers.

The first ink layer may preferably comprise a heat-fusible material and a colorant, and may optionally comprise a dispersing agent, plasticizer, filler, etc. As the materials constituting the first ink layer, those for the above-mentioned heat-transferable ink layer 4 may be used as such.

The second ink layer may preferably comprise a material capable of having a large adhesion to a recording medium. Examples of such a material may include one or more materials, such as a homopolymer or copolymer of olefin, such as polyethylene, polypropylene, polyisobutylene, ethylene-vinyl acetate copolymer, ethylene-acrylic acid copolymer, and ethylene-ethyl acrylate copolymer, or derivatives of these; heat-sensitive adhesives of polyamide, polyester, polyurethane or acrylic resin-type; and styrene-type block copolymers, such as styrene-isobutylene copolymer, styrene-butadiene copolymer, and styrene-ethylenebutylene copolymer. Among these, ethylene-acrylic acid copolymer, ethylene-ethyl acrylate copolymer, ethylenevinyl acetate copolymer, polyamide, polyester, or an acrylic resin may preferably be used, preferably in an amount of 60% or more. Further, it is also possible to add a tackifier, such as alicyclic hydrocarbon, terpene, or rosin; a filler, such as talc or calcium carbonate, and a stabilizer such as an antioxidant.

In the present invention, the heat-transferable ink layer 4 may preferably have a thickness in the range of 0.5 to 20μ, further preferably 1.5 to 8μ. In case where the heat-transferable ink layer 4 has a structure of two or more layers, it is preferred that the total ink layer has a thickness above range, and each layer has a thickness of 0.1 to 10μ, more preferably 0.2–4μ.

In the thermal transfer material of the present invention, various dyes or pigments generally used in the field of printing and recording may be used as the colorant. Specific examples of such colorant may include one or more of known dyes or pigments such as carbon black, Nigrosin dyes, lamp black, Sudan Black SM, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Kayaset YG, Smiplast Yellow GG, Zapon Fast Orange RR, Oil Scarlet, Smiplast Orange G, Orasol Brown G, Zapon Fast Scarlet CG, Aizen Spiron Red BEH, Oil Pink OP, Victoria Blue F4R, Fastgen Blue 5007, Sudan Blue, and Oil Peacock Blue.

The colorant may preferably be contained in the heat-transferable ink layer 4, but the intermediate layer 3 can also contain a colorant. In case where the heat-transferable ink layer 4 is composed of two ink layers, it is preferred that the colorant is contained in the first ink layer, but the intermediate layer or second ink layer can also contain a colorant.

In case where the heat-transferable ink layer 4 has either a one-layer structure or a two-layer structure, the colorant may preferably be contained in a proportion in the range of 3–60%, more preferably 10–50% based on the total weight of the heat-transferable ink layer 4 and the intermediate layer 3. Less than 3% results in a low transferred image density, and more than 60% results in a poor transfer characteristic.

As the support 2, it is possible to use films or papers known in the art as such. For example, films of plastics having relatively good heat-resistance such as polyester, polycarbonate, triacetylcellulose, polyamide, polyimide, etc., cellophane parchment paper or capacitor paper can e preferably used. Also, in the case of using a thermal head as an heat-application means, the surface of the support to contact the thermal head can be provided with a heat-resistant protective layer comprising a silicone resin, a fluorine-containing resin, a polyimide resin, an epoxy resin, a phenolic resin, a melamine resin or nitrocellulose to improve the heat resistance of the support. Alternatively, a support material which could be used in the prior art can also be used by provision of such a protective layer.

The support 2 should preferably have a thickness desirably of about 1 to 15μ, when a thermal head is used as a heating source during heat transfer. However, the thickness is not particularly limited when a heating source capable of heating selectively the heat-transferable ink layer such as laser beam is used.

The thermal transfer material of the present invention may be prepared, e.g., in the following manner.

First, the above-mentioned emulsion of oxidized polyethylene is applied onto a support or substrate 2 to form an intermediate layer 3.

Then, the thermal transfer material 1 according to the present invention may be prepared by fusion blending or kneading optionally with an appropriate solvent, the heat-fusible material, colorant and other additives to be optionally added by means of a dispersing means such as an attritor to obtain an ink which is heat-fused or in the state of solutions or dispersions, applying the ink on the intermediate layer 3 by means of an applicator, etc., followed by drying, if desired.

The planar shape of the heat-sensitive transfer material of the present invention is not particularly limited, but it is generally shaped in the form of a ribbon as in a typewriter ribbon or a rather wide tape as used in line printers, etc. Also, for the purpose of color recording, it can be formed as a transfer material in which thermal transfer inks in several colors are applied in stripes or blocks.

Now, as an aid for comprehension, the operation of a thermal transfer recording method employing the above thermal transfer material is described by referring to the case in which a thermal head is employed as the most typical heat source, while such transfer recording method is not particularly different from ordinary one.

Figure 2:
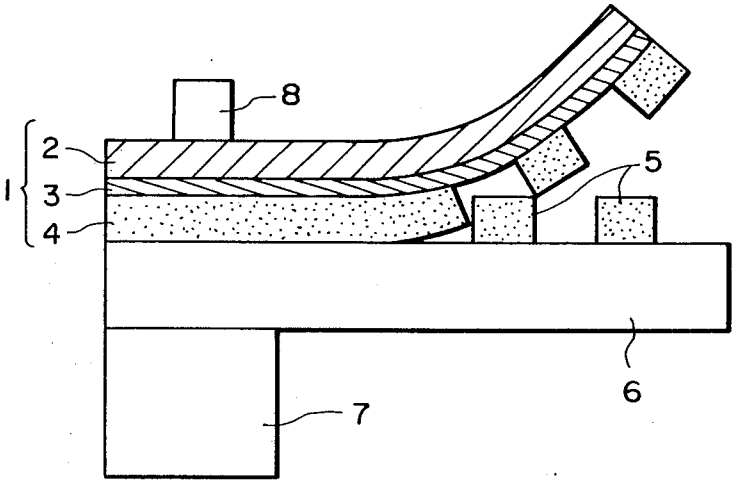
FIG. 2 is a schematic sectional view which illustrates a thermal transfer recording method using an embodiment of the thermal transfer material according to the present invention.

FIG. 2 is a sectional view taken in the thickness direction of the transfer material for schematically illustrating a mode of operation. More specifically, referring to FIG. 2, a thermal transfer material 1 is superposed on a recording medium 6 so that the heat-transferable ink layer 4 thereof is caused to closely contact the recording medium 6, a heat pulse is applied to the thermal transfer material 1 by means of a thermal head 8, while the back side of the recording medium 6 is supported by a platen 7, thereby to selectively heat the heat-transferable ink layer 4 corresponding to a desired printing or transfer pattern. The temperature in the heat-applied portion of the heat-transferable ink layer 4 is elevated, and the ink layer 4 is selectively transferred to the recording medium 6 to form a transferred image 5 on the reocrding medium.

While a thermal head is used as a heat source for thermal transfer recording in the above embodiment, it should easily be understood that such recording may be effected in a similar manner by using another heat source such as a laser beam.

Hereinbelow, the present invention will be explained in further detail with reference to Examples. Incidentally, the number-average molecular weight of oxidized polyethylene was measured in the following manner.

[Molecular Weight Measurement]

The VPO method (Vapor Pressure Osmometry Method) is used. A sample polymer is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0 = RT/Mn$, the number average molecular weight Mn of the sample is derived.

EXAMPLE 1

| <Prescription 1> | |
|---|---|
| Oxidized polyethylene (number-average molecular weight: 1450, m.p. = 100° C.) | 40 parts |
| Rhodamic acid (1-phenanthrenecarboxylic acid, 1,2,3,4,4A,9,10,10A-octahydro-1,4A-dimethyl-7-(1-methylethyl)-) | 10 parts |
| Amine (Triethanolamine) | 5 parts |
| Water | 160 parts |

The component of the above prescription 1 were emulsified under heating and pressure to prepare an oxidized polyethylene emulsion. The emulsion (solid content: 25%) was applied onto a 6 μ-thick PET (polyethylene terephthalate) film by means of an applicator and dried at 60° C. for 3 min. to form a 1.0 μm-thick intermediate layer 3.

| <Prescription 2> | |
|---|---|
| Ethylene-vinyl acetate copolymer emulsion (MI (melt index): 6, vinyl acetate content: 28%, non-volatile matter: 25%) | 40 parts |
| Urethane resin emulsion (SP (softening point): 180° C., non-volatile matter: 25%) | 5 parts |
| Vinyl acetate-ethylene copolymer emulsion (Vinyl acetate content: 86%, non-volatile matter: 25%) | 15 parts |
| Carbon black aqueous dispersion | 40 parts |
| <Prescription 3> | |
| Ethylene-vinyl acetate copolymer emulsion (MI: 15, vinyl acetate content: 28%, non-volatile matter: 25%) | 45 parts |
| Ethylene-methacrylic acid-styrene copolymer emulsion (copolymerization ratio = 60:10:30, non-volatile matter: 25%) | 25 parts |
| Vinyl acetate-ethylene copolymer emulsion (Vinyl acetate content: 86%, non-volatile matter: 25%) | 30 parts |

(The amounts of emulsion and aqueous dispersion for providing an ink formulation are all expressed based on their solid contents, and the physical properties and content of a component are those obtained with respect to a base resin concerned. The same expressions are also used in the other Examples).

The components of the above prescription 2 and those of the prescription 3 were respectively mixed uniformly by means of a propeller-type stirrer to prepare a coating liquids 2 and a coating liquid 3, respectively.

The coating liquid 2 was applied onto the intermediate layer 3 formed above by means of an applicator, and dried at 60° C. for 1 min. by hot-air, to form a 1.5 μm-thick first heat-transferable ink layer. Then, the coating liquid 3 was applied onto the first heat-transferable ink layer b means of an applicator, and dried at 60° C. for 1 min. by hot-air, to form a 1.7 μm-thick second heat-transferable ink layer, whereby a thermal transfer material according to the present invention was obtained.

EXAMPLE 2

| <Prescription 4> | |
|---|---|
| Oxidized polyethylene (number-average molecular weight: 1950, m.p. = 110° C.) | 40 parts |
| Stearic acid | 10 parts |
| Potassium hydroxide | 1 part |
| Water | 160 parts |

The components of the above prescription 4 were emulsified under heating and pressure to prepare an oxidized polyethylene emulsion.

The oxidized polyethylene emulsion (solid content: 25%) was applied onto a 6 μm-thick polyethylene terephthalate film in the same manner as in Example 1 to form an intermediate layer.

Then, the coating liquids 2 and 3 are successively applied onto the intermediate layer in the same manner as in Example 1 to obtain a thermal transfer material.

EXAMPLE 3

| <Prescription 5> | |
|---|---|
| Oxidized polyethylene (number-average molecular weight: 1950, m.p. = 110° C.) | 40 parts |
| Polyoxyethylene nonylphenyl ether (mole of ethylene oxide: 9-11 mole per 1 mole of the nonylphenyl group) | 10 parts |
| Potassium hydroxide | 0.9 part |
| Water | 158 parts |

A thermal transfer material was prepared in the same manner as in Example 2 except that the components of the above prescription 5 were used instead of those of the prescription 4 used in Example 2.

EXAMPLE 4

| <Prescription 6> | |
|---|---|
| Oxidized polyethylene (number-average molecular weight: 1450, m.p. = 100° C.) | 40 parts |
| Dodecyl alcohol sulfuric acid ester sodium salt | 10 parts |
| Water | 160 parts |

A thermal transfer material was prepared in the same manner as in Example 2 except that the components of the above prescription 6 were used instead of those of the prescription 4 used in Example 2.

EXAMPLE 5

| <Prescription 7> | |
|---|---|
| Ethylene-vinyl acetate copolymer emulsion (MI: 15, vinyl acetate content: 28%, non-volatile matter: 25%) | 35 parts |
| Ethylene-methacrylic acid styrene copolymer emulsion (copolymerization ratio = 60:10:30, non-volatile matter: 25%) | 20 parts |
| Vinyl acetate-ethylene copolymer emulsion (vinyl acetate content: 86%, non-volatile matter: 25%) | 30 parts |
| Carbon black aqueous dispersion | 15 parts |

An intermediate layer was formed on a support in the same manner as in Example 1. Then, a 3.0 μm-thick heat-transferable ink layer was formed on the intermediate layer by using the components of the above prescription 7 in the same manner as in Example 1, whereby a thermal transfer material according to the present invention was obtained.

COMPARATIVE EXAMPLE 1

| <Prescription 8> | |
|---|---|
| Oxidized polyethylene (number-average particular weight: 5000, m.p. = 140° C.) | 40 parts |
| Polyoxyethylene nonlylphenyl ether (mole of ethylene oxide: 9-11 mole) | 10 parts |
| Potassium hydroxide | 0.9 part |
| Ethylene glycol | 1.7 parts |
| Water | 158 parts |

The components of the above prescription 8 were emulsified under heating and pressure to prepare an oxidized polyethylene emulsion. The oxidized polyethylene emulsion (solid content: 25%) was applied onto a 6 μm-thick polyethylene terephthalate film in the same manner as in Example 1 to form an intermediate layer.

Then, the coating liquids 2 and 3 were successively applied onto the intermediate layer in the same manner as in Example 1 to obtain a thermal transfer material.

COMPARATIVE EXAMPLE 2

| <Prescription 9> | |
|---|---|
| Carnauba wax (number-average molecular weight: 500, m.p. = 85° C.) | 26 parts |
| Polyoxyethylene lauryl ether (HLB = 19) | 4 parts |
| Water | 70 parts |

A thermal transfer material was prepared in the same manner as in Comparative Example 1 except that the components of the above prescription 9 were used instead of those of the prescription 8 used in Comparative Example 1.

Figure 3:
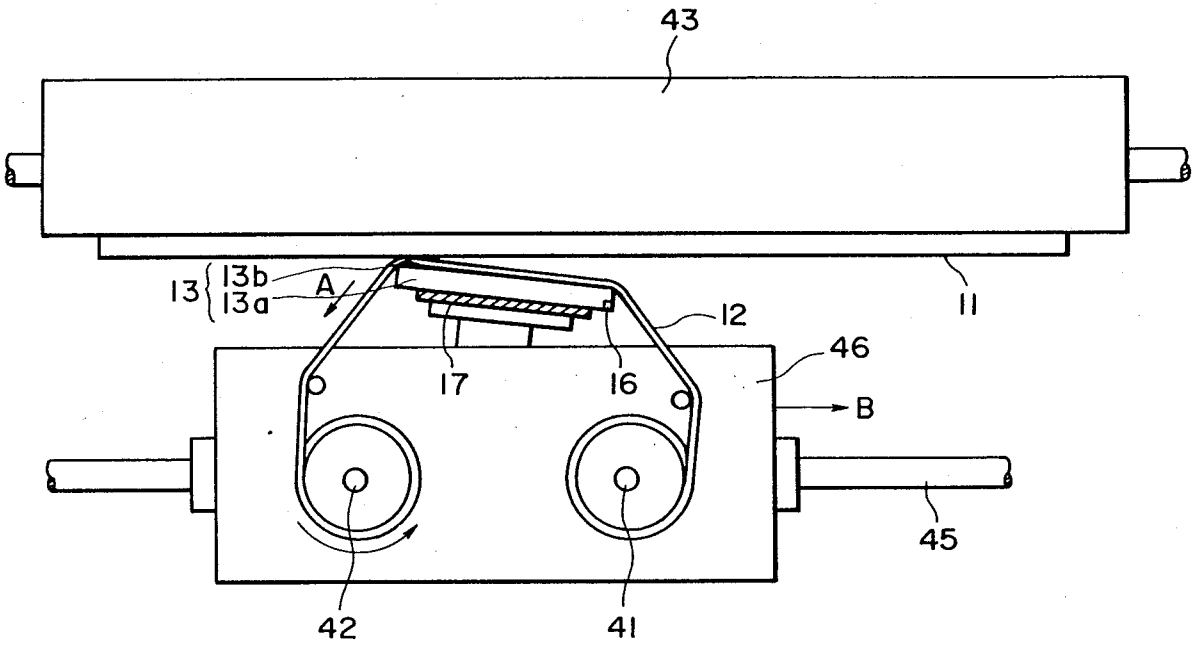
FIG. 3 is a schematic plan view illustrating a thermal transfer recording apparatus using the thermal transfer material according to the present invention.

Then, the seven kinds of thermal transfer materials obtained in the above Examples and Comparative Examples were respectively slit into 8 mm-wide ribbon, and recording was effected on two record papers respectively having a Bekk smoothness of 2 sec and 100 sec, by means of a thermal printer as shown in FIG. 3 (trade name: ETW SP400X, mfd. by Canon K.K.).

In the recording apparatus shown in FIG. 3, reference numeral 11 denotes record paper as a recording medium, and numeral 12 denotes a thermal transfer material. For imagewise heating of the transfer material 12, a thermal head 13 comprising heat-generating elements (or heating elements) **13*b* disposed on a substrate 13*a*. The thermal head 13 as a whole is heated by a heater 17, and the temperature of the substrate 13*a* of the thermal head 13 is detected by a temperature detecting element 16. Both ends of the thermal transfer material 12 are wound about a feed roller 41 and a take-up roller 42, and the transfer material 12** is gradually fed in the direction of an arrow A.

The thermal head 13 is affixed to a carriage 46 and is caused to push a back platen 43 at a prescribed pressure while sandwiching the record paper 11 and the thermal transfer material 12. The carriage 46 is moved along a guide rail 45 in the direction of an arrow B. Along with the movement, recording is effected on the record paper 11 by the thermal head 13.

Prior to the recording operation, the heater 17 is energized, and the heat-transferable ink layer (not shown) of the thermal transfer material 12 is controlled at a prescribed temperature $T_0$ while monitoring the temperature of the substrate **13*a* by the temperature detecting element 16. The temperature $T_0$ is so controlled as to satisfy a condition that the temperature $T_0$ is lower than the temperature $T_1$ at which the heat-transferable ink layer begin to transfer to the recording medium 11 (i.e., transfer-initiation temperature). Generally, the temperature $T_0$ may preferably be set to a temperature in the range of 35° C. to 60° C. The thermal transfer material 12 is heated up to the temperature $T_0$ while it moves along the thermal head 13**.

Thus, when the heat-transferable ink layer is heated to the prescribed temperature $T_0$ prior to the recording operation, the temperature distribution in the ink layer becomes relatively smooth whereby there can be obtained a recorded image which does not excessively penetrate into the record paper. Incidentally, the heater 17 is not necessarily required, and therefore the $T_0$ may be room temperature. In the recording by use of the above-mentioned seven kinds of thermal transfer materials, however, the $T_0$ was controlled at a temperature of (50±3)° C.

In this instance, heating elements **13*b* arranged at a density of 240 dots (elements)/mm of the thermal head 13** were energized by a power of 0.36 W/dot for a duration of 0.8 msec while moving the thermal head at a speed of 20 cps. In this manner, thermal transfer recording was effected on two record papers having Bekk smoothness of 2 sec and 100 sec, respectively. The results are shown in Table 1 appearing hereinafter.

TABLE 1

| Evaluation of recorded images | On Bekk smoothness of 2 sec | | On Bekk smoothness of 100 sec | |
|---|---|---|---|---|
| | Edge sharpness | Lacking of images | Edge sharpness | Lacking of images |
| Example | | | | |
| 1 | o | o | o | o |
| 2 | o | o | o | o |
| 3 | o | o | o | o |
| 4 | o | o | o | o |
| 5 | o | o | o | o |
| Comparative Example | | | | |
| 1 | x | x | o | o |
| 2 | x | x | x | o |

In the above Table 1, the symbols have the following meanings:
(Edge sharpness)
o: The edges of the transferred image were desirably almost linear.
x: The edges of the transferred image were uneven and the image was not suitable for practical use.
(Lacking of image)
o: The transferred image desirably corresponded to the energized heating elements (dots).
x: The transferred image did not correspond to the energized heating elements (dots), and the lacking of the image occurred.

As summarized in Table 1 above, the thermal transfer materials according to the present invention provided transfer recorded images with good quality which were free of lacking of images, and have good edge sharpness on both rough paper (Bekk smoothness: 100 sec) and smooth paper (Bekk smoothness: 2 sec).

On the other hand, thermal transfer materials of Comparative Examples 1 and 2 provided recorded images with inferior quality wherein edge sharpness was poor and lacking of images was caused due to incomplete transfer.

As described hereinabove, according to the present invention, there is provided a thermal transfer material comprising a support, an intermediate layer, and a heat-transferable ink layer disposed in this order on the support, wherein the intermediate layer comprising oxidized polyethylene having a number-average molecular weight of 1300–2500, and at least one species selected from polyoxyethylene alkylaryl ether, fatty acid, resin acid, amine and sulfuric acid ester salt.

The thermal transfer material of the present invention can provide transferred images excellent in edge-cutting and transfer characteristics, not only on a recording medium having good surface smoothness but also on a recording medium having poor surface smoothness.

What is claimed is:

1. A thermal transfer material comprising: a support, an intermediate layer, and a heat-transferable ink layer which comprises a heat fusible material disposed in this order on the support; said intermediate layer comprising oxidized polyethylene having a number-average molecular weight of 1300–2500, and at least one species selected from the group consisting of polyoxyethylene alkylaryl ether, resin acid, and sulfuric acid ester salt.

2. A thermal transfer material according to claim 1, wherein said oxidized polyethylene has a number-average molecular weight of 1400–2200.

3. A thermal transfer material according to claim 1, wherein said heat-transferable ink layer has a two layer structure comprising a first ink layer and a second ink layer.

4. A thermal transfer material according to claim 1, wherein said heat-transferable ink layer comprises a resinous heat-fusible material in an amount of 70 wt. % or more based on the weight of the heat-fusible material thereof.

5. A thermal transfer material according to claim 1, wherein said intermediate layer further comprises a polar material.

6. A thermal transfer material according to claim 5, wherein said polar material is an acrylic resin or a vinyl acetate resin.

7. A thermal transfer material according to claim 1, wherein said intermediate layer is formed by the process of contacting an oxidized polyethylene having a number-average molecular weight of 1300–2500, with a resin acid and a neutralizing agent of an amine salt.

8. A thermal transfer material according to claim 7, wherein said intermediate layer is formed by the process of contacting the oxidized polyethylene with the resin acid and neutralizing agent under conditions of temperature and pressure sufficient to form an aqueous emulsion of oxidized polyethylene.

* * * * *

UNITED STATES PATENT AND TRADEMARK OFFICE

CERTIFICATE OF CORRECTION

PATENT NO. : 4,894,288

DATED : January 16, 1990

INVENTOR(S) : TSUGUHIRO FUKUDA, ET AL.

It is certified that error appears in the above-identified patent and that said Letters Patent is hereby corrected as shown below:

COLUMN 1

Line 12, "and" (second occurrence) should be deleted.

COLUMN 3

Line 57, "which" should read --which the--.

COLUMN 4

Line 54, "arcylic resin" should read --acrylic resin--.

COLUMN 5

Line 6, "a" (second occurrence) should be deleted.
Line 68, "posed" should read --posed a--.

COLUMN 6

Line 34, "heat-transferabl" should read --heat-transferable--.

COLUMN 7

Line 22, "ethylenemethacrylic" should read --ethylene-methacrylic--.
Line 44, "styrene-ethylenebutylene" should read --styrene-ethylene-butylene--.
Line 46, "ethylenevinyl" should read --ethylene-vinyl--.

UNITED STATES PATENT AND TRADEMARK OFFICE

CERTIFICATE OF CORRECTION

PATENT NO. : 4,894,288

DATED : January 16, 1990

INVENTOR(S) : TSUGUHIRO FUKUDA, ET AL.

It is certified that error appears in the above-identified patent and that said Letters Patent is hereby corrected as shown below:

COLUMN 8

Line 31, "e" should read --be--.
Line 32, "an" should read --a--.

COLUMN 9

Line 6, "from" should read --from an--.
Line 24, "reocrding" should read --recording--.
Line 62, "component" should read --components--.

COLUMN 10

Line 35, "coating liquids 2" should read --coating liquid 2--.
Line 39, "hot-air," should read --hot air,--.
Line 42, "b" should read --by--.
Line 43, "hot-air," should read --hot air,--.

COLUMN 11

COMPARATIVE EXAMPLE 1, "nonlylphenyl" should read --nonylphenyl--.

COLUMN 12

Line 35, "disposed" should read --is disposed--.
Line 59, "begin" should read --begins--.

UNITED STATES PATENT AND TRADEMARK OFFICE

CERTIFICATE OF CORRECTION

PATENT NO. : 4,894,288

DATED : January 16, 1990

INVENTOR(S) : TSUGUHIRO FUKUDA, ET AL.

It is certified that error appears in the above-identified patent and that said Letters Patent is hereby corrected as shown below:

COLUMN 14

Line 2, "comprising" should read --is comprised of--.
Line 15, "heat fusible" should read --heat-fusible--.
Line 25, "two layer" should read --two-layer--.

Signed and Sealed this

Twenty-sixth Day of May, 1992

*Attest:*

DOUGLAS B. COMER

*Attesting Officer*

*Acting Commissioner of Patents and Trademarks*